US007542001B2

(12) United States Patent
Chen et al.

(10) Patent No.: US 7,542,001 B2
(45) Date of Patent: Jun. 2, 2009

(54) DUAL BROADBAND DIPOLE ARRAY ANTENNA

(75) Inventors: Tzu-Chiang Chen, Taoyuan Hsien (TW); Wen-Kuan Su, Miaoli Hsien (TW)

(73) Assignee: National Defense University, Taoyuan Hsien (TW)

( * ) Notice: Subject to any disclaimer, the term of this patent is extended or adjusted under 35 U.S.C. 154(b) by 112 days.

(21) Appl. No.: 11/856,207

(22) Filed: Sep. 17, 2007

(65) Prior Publication Data

US 2009/0073071 A1 Mar. 19, 2009

(51) Int. Cl.
*H01Q 9/28* (2006.01)

(52) U.S. Cl. ..... 343/795; 343/810; 343/820

(58) Field of Classification Search ..... 343/795, 343/807, 810, 816, 820
See application file for complete search history.

(56) References Cited

U.S. PATENT DOCUMENTS 6,809,697 B2 * 10/2004 Churng-Jou et al. ..... 343/792
7,042,415 B2 * 5/2006 Cheng ..... 343/795
7,268,737 B1 * 9/2007 Ai et al. ..... 343/795

* cited by examiner

*Primary Examiner*—Hoang V Nguyen
(74) *Attorney, Agent, or Firm*—Rabin & Berdo, P.C.

(57) ABSTRACT

A dual broadband dipole array antenna has a grounding structure, a circuit module and two feeding boards. The grounding structure is a conductive hexagonal container with two open ends and has two opposite parallel panels. The circuit module is a transmitting antenna module, is phase reversible and has two feeding wires. The feeding wires of the circuit module are respectively mounted centrally through the parallel panels and each feeding wire is electrically connected to the corresponding feeding board. When in use, the dual broadband dipole array antenna transmits signals covering EGSM900 (880-960 MHz), GSM1800 (1710-1880 MHz) and PCS (1820-1970 MHz).

10 Claims, 7 Drawing Sheets

DUAL BROADBAND DIPOLE ARRAY ANTENNA

BACKGROUND OF THE INVENTION

1. Field of Invention

The present invention relates to an antenna, and more particularly to a dual broadband dipole array antenna that is capable of transmitting electromagnetic waves for wireless communication systems at different frequency bands.

2. Description of the Related Art

Mobile devices, such as mobile phones, personal digital assistants, smart phones or the like, use a wireless communication system to connect to internet using a service provider utilizing a general packet radio service (GPRS).

However, different frequency bands are adopted for different wireless communication systems so different antenna corresponding to different wireless communication systems are used to transmit signals under the corresponding frequency bands, which is costly and troublesome for the service providers since antenna have a cost of production as well as requiring erection costs, maintenance costs, land rental and erection approval. By integrating more than one bandwidth into each antenna, these costs are reduced.

However, some conventional broadband antenna capable of transmitting signals under a board frequency bandwidth have been taught, but antenna gains, radiation patterns or signal volume are not suitable for transmitting signals of different wireless communication systems.

The present invention provides a dual broadband dipole array antenna to obviate or mitigate the shortcomings of the conventional broadband antenna.

SUMMARY OF THE INVENTION

The primary objective of the present invention is to provide a dual broadband dipole array antenna that can radiate signals covering two frequency bands.

The dual broadband dipole array antenna has a grounding structure, a circuit module and two feeding boards. The grounding structure is a conductive hexagonal container, with two open ends and has two opposite parallel panels. The circuit module is a transmitting antenna module, is phase reversible and has two feeding wires. The feeding wires of the circuit module are respectively mounted centrally through the parallel panels and each feeding wire is electrically connected to the corresponding feeding board. When in use, the dual broadband dipole array antenna transmits signals covering EGSM900 (880-960 MHz), GSM1800 (1710-1880 MHz) and PCS (1820-1970 MHz).

Other objectives, advantages and novel features of the invention will become more apparent from the following detailed description when taken in conjunction with the accompanying drawings.

DETAILED DESCRIPTION OF THE INVENTION

Figure 1:
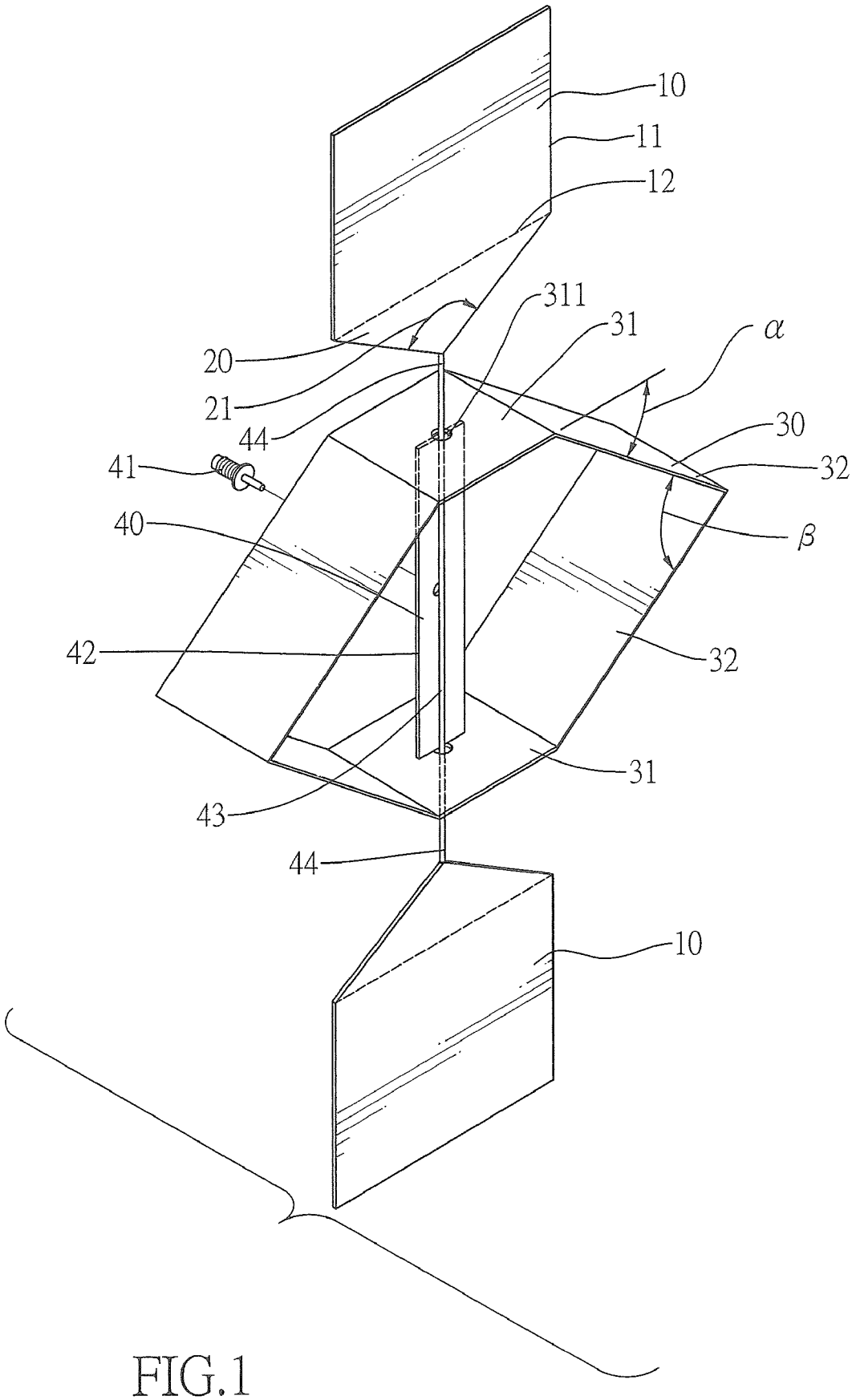
FIG. 1 is a perspective view of a dual broadband dipole array antenna in accordance with the present invention.

With reference to FIG. 1, a dual broadband dipole array antenna in accordance with the present invention comprises a grounding structure (30), a circuit module (40) and two feeding boards (20).

The grounding structure (30) is a conductive, hexagonal container, open at two ends and comprises two parallel panels (31) and four congruent panels (32).

The parallel panels (31) are conductive, mounted parallel to each other, and each parallel panel (31) has a hole (311), two connecting edges and two non-connecting edges. The hole (311) is centrally formed through the parallel panel (31). The connecting edges are formed opposite to each other. In a first embodiment of the present invention, the non-connecting edges of the parallel panels (31) are 20 mm.

The congruent panels (32) are conductive, formed in pairs and each has two connecting edges and two non connecting edges. The pairs of congruent panels (32) are formed on and protrude respectively from the corresponding connecting edges of the parallel panels (31) at an outer angle ($\alpha$) from the parallel, to form an apex having an inner angle ($\beta$). In the first embodiment of the invention, the outer angle ($\alpha$) is 35°, the inner angle ($\beta$) is 70°, the non-connecting edge of each congruent panel (32) is 60 mm and the connecting edge of each congruent panel (32) is 20 mm. The pairs of congruent panels (32) are symmetrical to each other. The circuit module (40) is a transmitting antenna circuit module and has a circuit board (42), a conductive wire (43), an ohmic plug (41) and two feeding wires (44).

The circuit board (42) is a printed circuit board, is phase reversible, may be FR4, glass-fiber board, dielectric board or the like, and has a front surface, a rear surface and a metal layer. The metal layer is formed on the rear surface of the circuit board (42).

The conductive wire (43) is formed longitudinally on the front surface of the circuit board (42), may be a coaxial wire and has two ends and a connecting point. In the first embodiment of the invention, a length difference between the connecting point to the ends is 47.5 mm to form a 180° phase difference for signals from the connecting point to the ends.

The ohmic plug (41) has an outer electrode and an inner electrode. The outer electrode of the ohmic plug (41) is electrically connected to the metal layer of the circuit board (42). The inner electrode of the ohmic plug (41) partially plugs through the circuit board (42) to electrically connect to the connecting point of conductive wire (43). The ohmic plug (41) receives signals from external signal sources and transmits the signals to the circuit board (42).

The feeding wires (44) are conductive and each has a length, a proximal end and a distal end. The proximal ends of the feeding wires (44) are connected respectively to the ends of the conductive wire (43). The distal ends of the feeding wires (44) are respectively mounted through the holes (311) of the parallel panels (31) and do not contact the grounding structure (30). In the first embodiment of the invention, the length of the feeding wire (44) is 3 mm.

Figure 7:
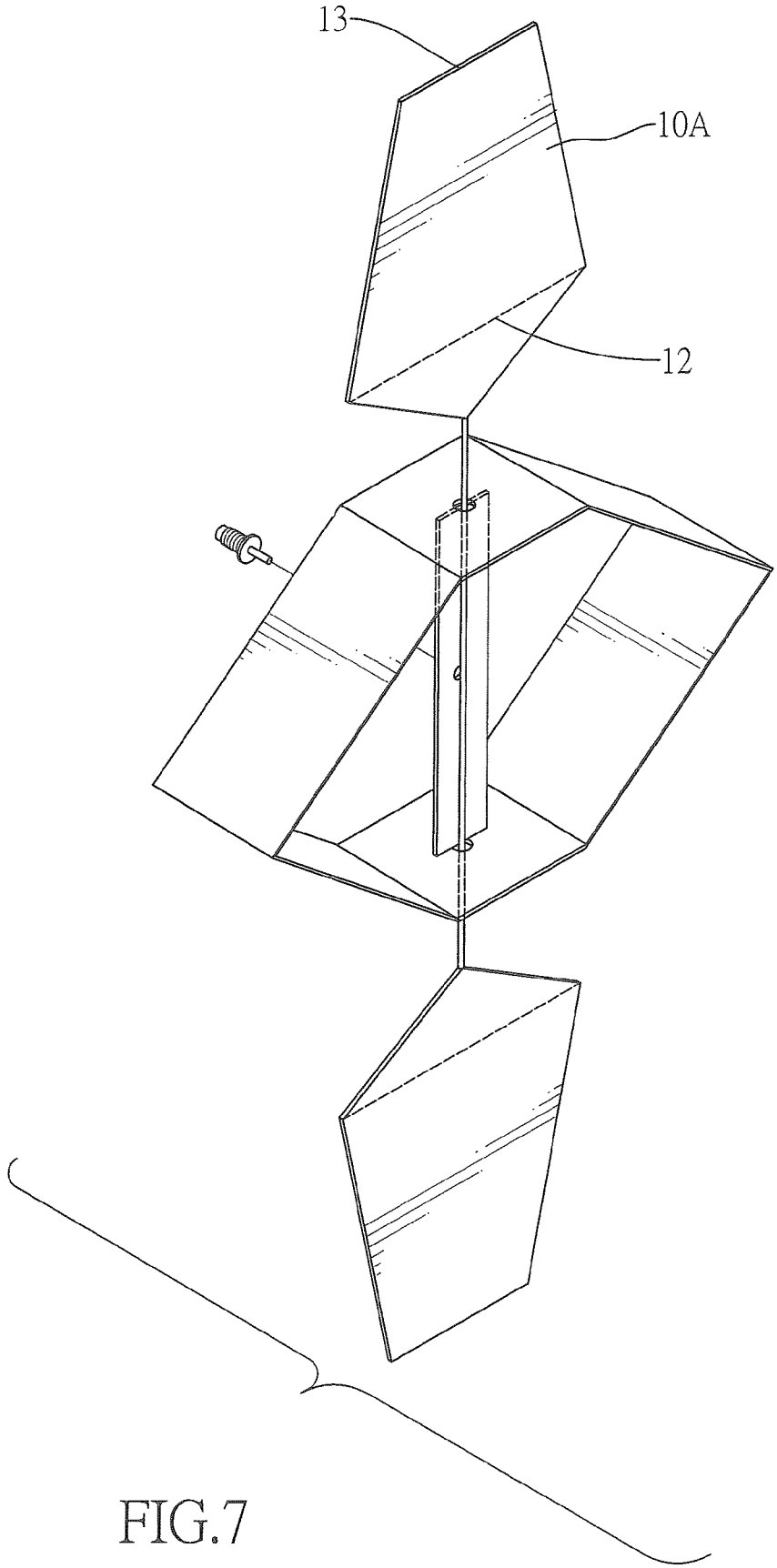
FIG. 7 is a perspective view of a second embodiment of the dual broadband dipole array antenna in accordance with the present invention.
Figure 8:
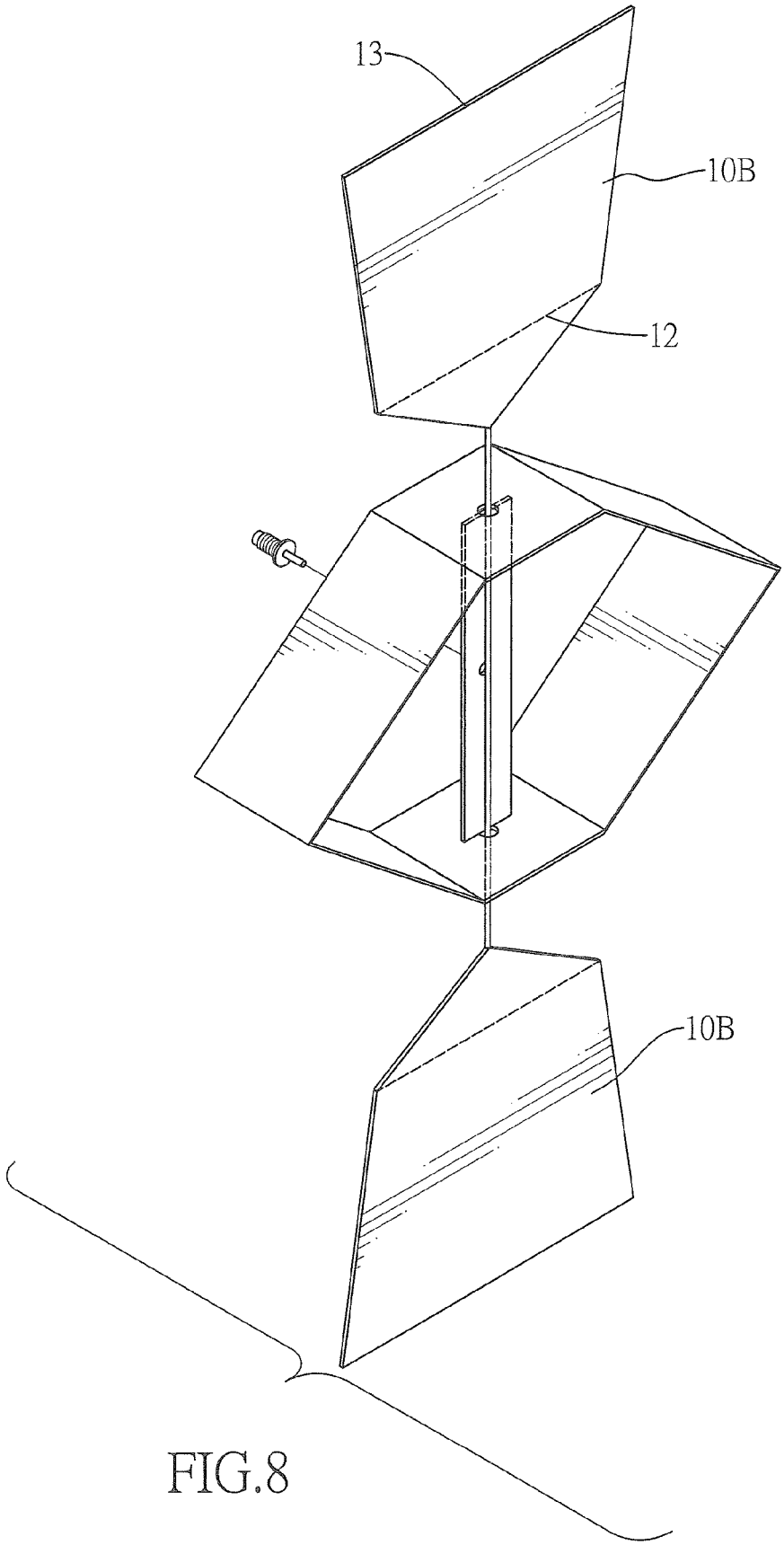
FIG. 8 is a perspective view of a third embodiment of the dual broadband dipole array antenna in accordance with the present invention.

With further reference to FIGS. 7 and 8, the feeding boards (20) are conductive, connected respectively to the distal ends of the feeding wires (44) and each comprises a triangular segment and a quadrangular segment (10, 10A, 10B).

The triangular segment has a vertex and a base edge (12). The vertex is connected respectively to the distal ends of the feeding wires (44) and has a vertex angle (21) that matches impedance for the signals sent from the circuit module (40) to the triangular segment. In the first embodiment of the invention, the vertex angle (21) is 135°. The base edge (12) is opposite to the vertex angle (21) and has a length. The length of the base edge (12) corresponds to a quarter of a wavelength of a center frequency of a primary operating frequency band. In the first embodiment of the invention, the base edge (12) is 60 mm.

Each quadrangular segment (10, 10A, 10B) is conductive and formed on and protrudes from the base edge (12) of the corresponding triangular segment and each has two side edges (11) and a distal edge. The side edges (11) relate to a ratio of a secondary operating frequency band to the primary operating frequency band. In the first embodiment of the invention the side edges (11) are 65 mm. The distal edge is opposite to the base edge (12) of the triangular segment.

The distal edge of the quadrangular segments (10, 10A, 10B) may be parallel to the base edge, may have a length equal to, shorter than or longer than the length of the base edge (12). In a first embodiment of the invention, the distal edge is parallel to and equal in length to the base edge (12).

Figure 2:
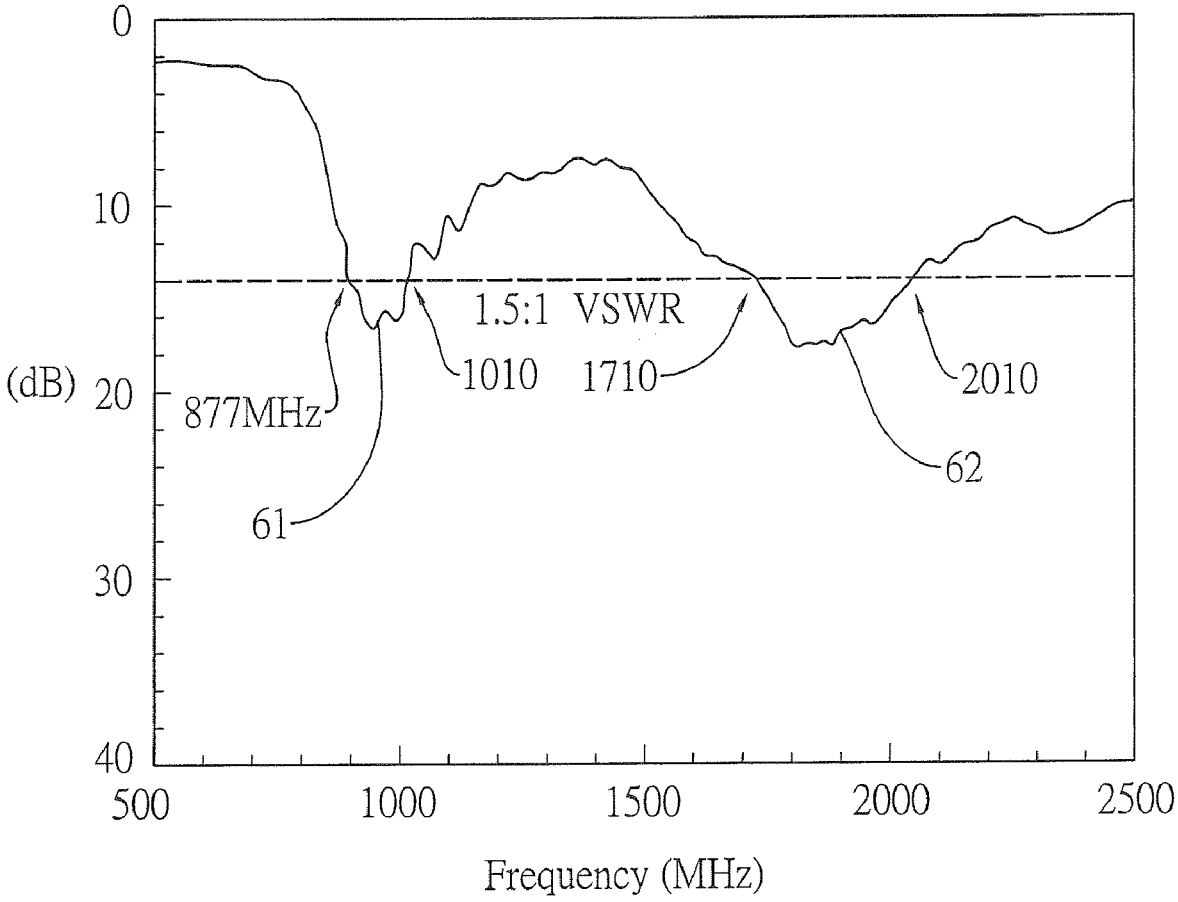
FIG. 2 is a plot of return loss measurement of the dual broadband dipole array antenna in FIG. 1.

With further reference to FIG. 2, a return loss of the first embodiment of the present invention is measured and shown. A primary central frequency (61) of the primary frequency operating frequency band is around 890 MHz. A secondary central frequency (62) of the secondary frequency operating frequency band is about 1850 MHz. Furthermore, bandwidths of the primary and the secondary operating frequency bands are about 880-960 MHz and 1710-1880 MHz respectively. Since central frequencies of extended global system for mobile communications (EGSM), personal communications services (PCS), and digital cellular system (DCS) are 880-960 MHz, 1710-1880 MHz and 1850-1970 MHz respectively, the primary and secondary central frequencies (61, 62) of the present invention can be applied for use with these systems.

Figure 3:
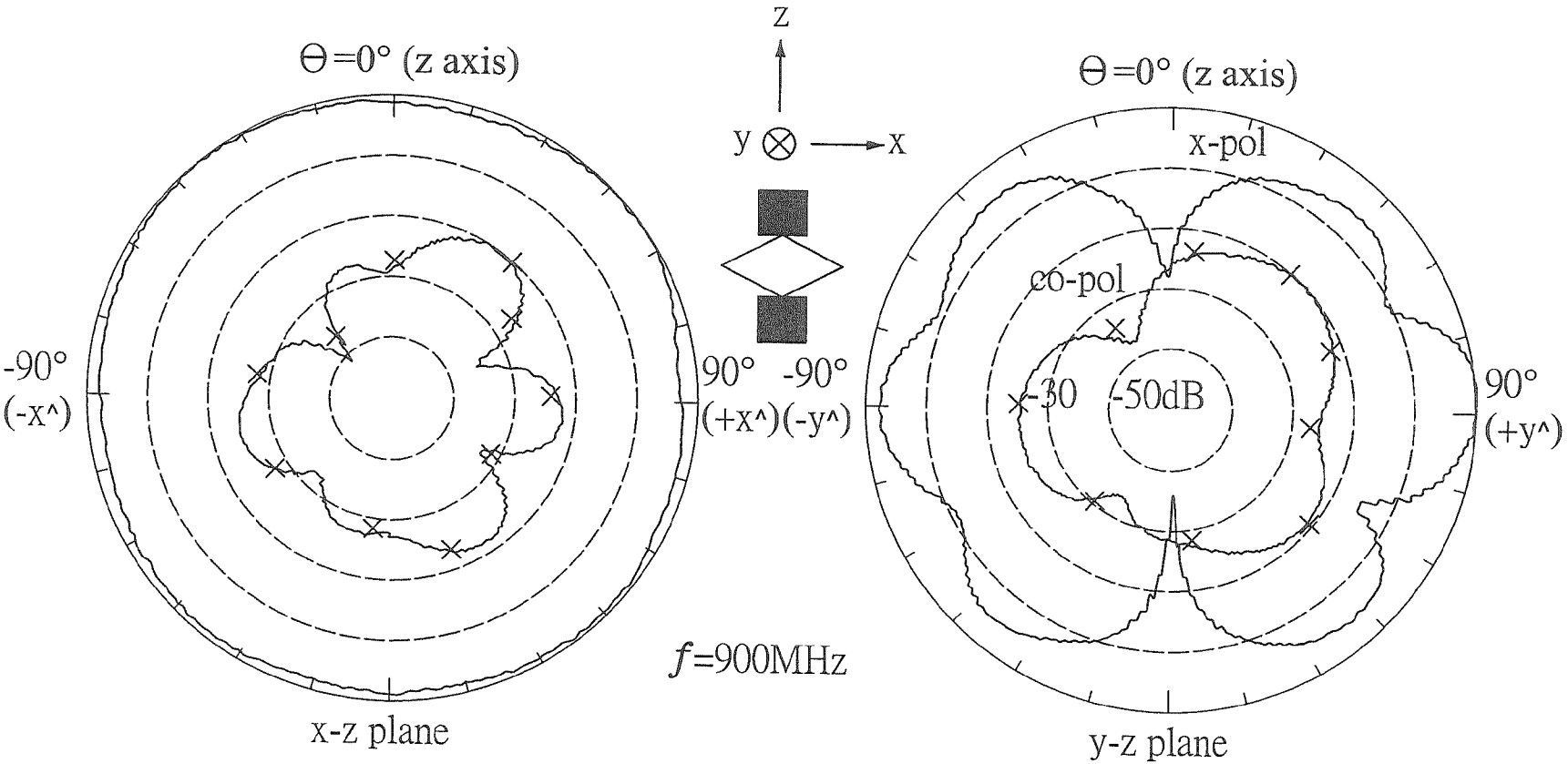
FIG. 3 is a radiation pattern measured at 900 MHz of the dual broadband dipole away antenna in FIG. 1.
Figure 4:
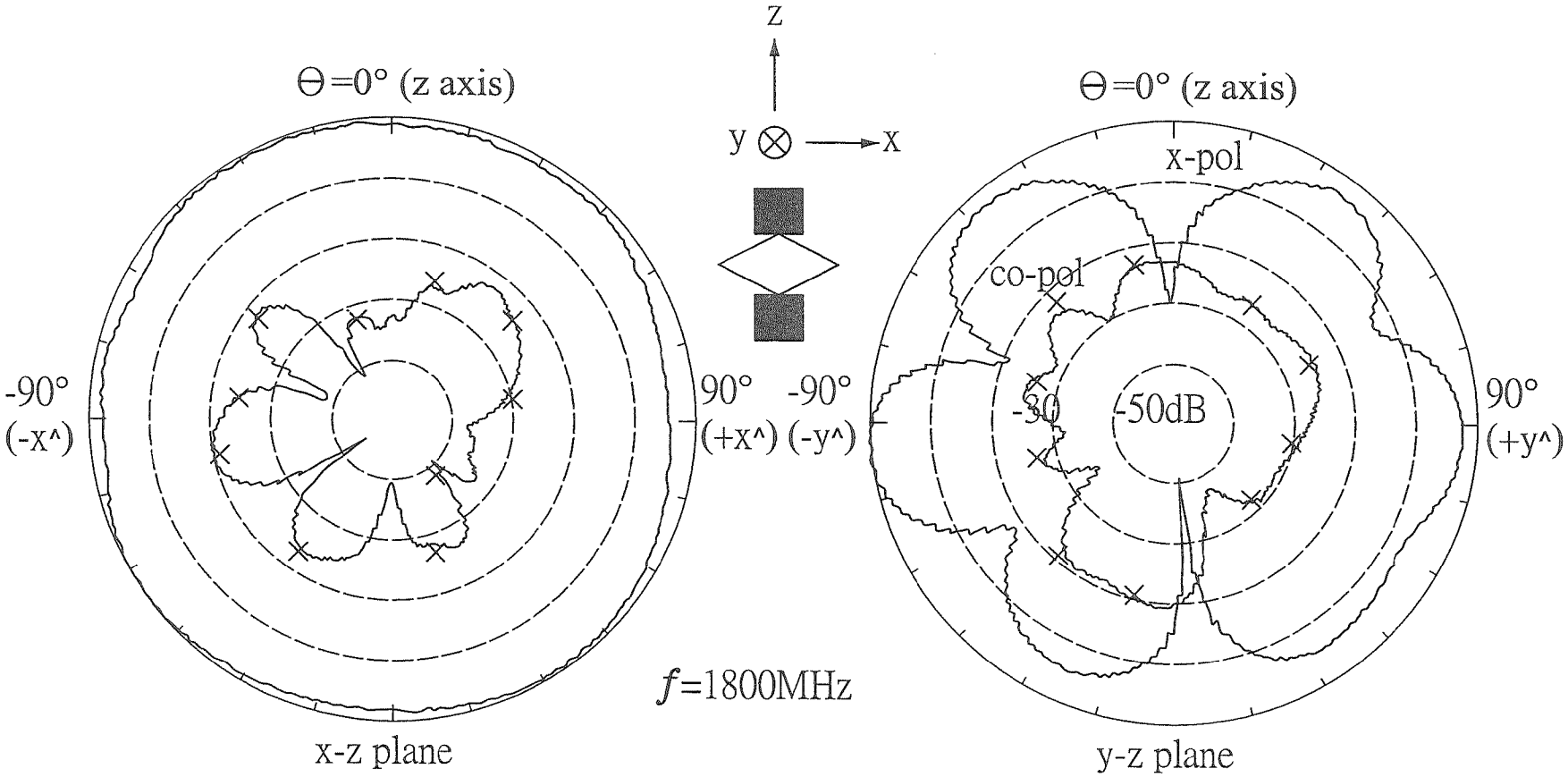
FIG. 4 is a radiation pattern measured at 1800 MHz of the dual broadband dipole array antenna in FIG. 1.

With further reference to FIGS. 3 and 4, radiation patterns of the first embodiment of the present invention measured at 900 MHz and 1800 MHz and shown respectively to show a uniform and a board direction of radiation are achieved.

Figure 5:
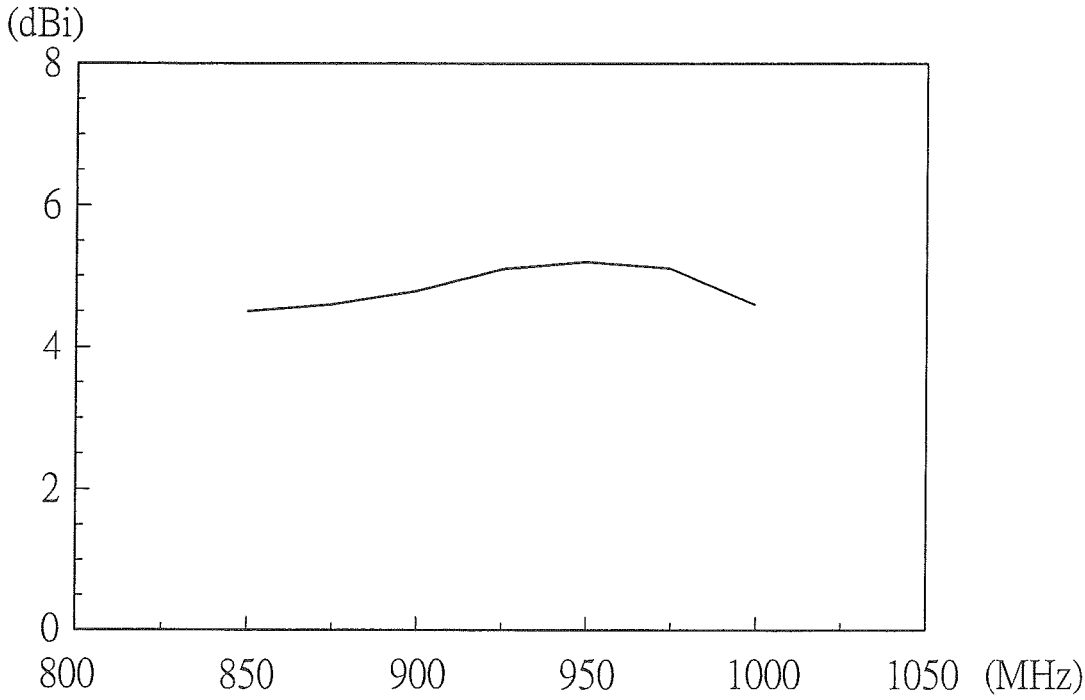
FIG. 5 is a plot of antenna gain measured at around 900 MHz of the dual broadband dipole array antenna in FIG. 1.
Figure 6:
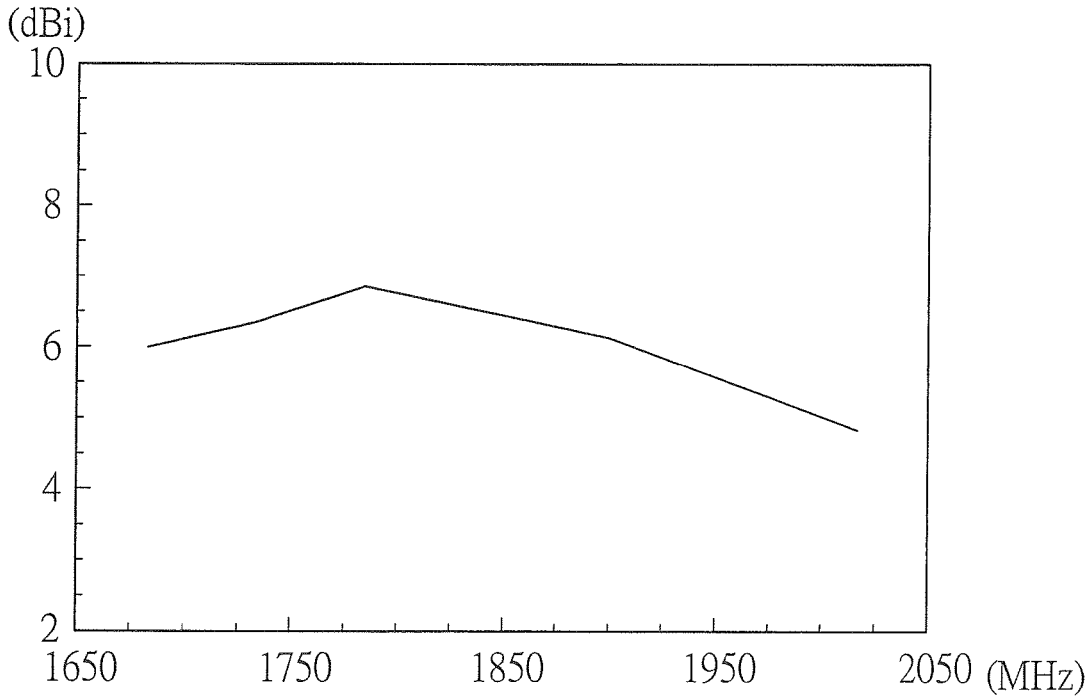
FIG. 6 is a plot of antenna gain measured at around 1800 MHz of the dual broadband dipole array antenna in FIG. 1.

With further reference to FIGS. 5 and 6, antenna gains of the first embodiment of the present invention measured at EGSM frequencies and PCS and DCS frequencies are shown respectively.

Even though numerous characteristics and advantages of the present invention have been set forth in the foregoing description, together with details of the structure and function of the invention, the disclosure is illustrative only. Changes may be made in detail, especially in matters of shape, size and arrangement of parts within the principles of the invention to the full extent indicated by the broad general meaning of the terms in which the appended claims are expressed.

What is claimed is:

1. A dual broadband dipole array antenna comprising a grounding structure being a conductive hexagonal container, open at two opposite ends and comprising two parallel panels being conductive, being mounted parallelly to each other and each having a hole being centrally formed through the parallel panel;

two connecting edges being formed opposite to each other; and two non-connecting edges; and four congruent panels being conductive, formed in pairs and each having two connecting edges; and two non-connecting edges;

where pairs of the congruent panels are formed on and protrude respectively from the connecting edges of the parallel panels at an outer angle from the parallel to form an apex having an inner angle and are symmetrical with respect to each other;

a circuit module being a transmitting antenna circuit module and having a circuit board being a printed circuit board and being phase reversible and having a front surface;

a rear surface; and a metal layer being formed on the rear surface of the circuit board;

a conductive wire being formed longitudinally on the front surface of the circuit board and heaving two ends and a connecting point, where a length difference between the connecting point to the ends forms a 180° phase difference for signals from the connecting point to the ends;

an ohmic plug receiving signals from external signal sources and transmitting the signals to the circuit board and having an outer electrode being electrically connected to the metal layer of the circuit board; and an inner electrode partially plugging through the circuit board to electrically connect to the connecting point of the conductive wire; and two feeding wires being conductive and each having a length;

a proximal end being connected one of the ends of the conductive wire; and a distal end being mounted through one of the holes of the parallel panels and isolating to the grounding structure; and two feeding boards being conductive, being connected respectively to the distal ends of the feeding wires and each comprises a triangular segment having a vertex being connected to the distal end of the corresponding feeding wire and having a vertex angle matching impedance for the signals sent from the circuit module to the triangular feeding boards; and a base edge being opposite to the vertex angle and having a length corresponding to a quarter of a wavelength of a center frequency of a primary operating band; and a quadrangular segment being conductive and formed on and protruding from the base edge of the corresponding triangular segment and each having two side edges; and a distal edge being opposite to the base edge of the triangular segment.

2. The dual broadband dipole array antenna as claimed in claim 1, wherein the conductive wire is a coaxial wire.

3. The dual broadband dipole array antenna as claimed in claim 1, wherein the distal edge of the quadrangular segments is equal to the length of the base edge of the triangular segment.

4. The dual broadband dipole array antenna as claimed in claim 3, wherein the conductive wire is a coaxial wire.

5. The dual broadband dipole array antenna as claimed in claim 1, wherein the distal edge of the quadrangular segments is shorter than the length of the base edge of the triangular segment.

6. The dual broadband dipole array antenna as claimed in claim 5, wherein the conductive wire is a coaxial wire.

7. The dual broadband dipole array antenna as claimed in claim 1, wherein the distal edge of the quadrangular segments is longer than the length of the base edge of the triangular segment.

8. The dual broadband dipole array antenna as claimed in claim 7, wherein the conductive wire is a coaxial wire.

9. The dual broadband dipole array antenna as claimed in claim 1, wherein the side edges of the quadrangular segment relates to a ratio of a secondary operating frequency band to the primary operating frequency band.

10. The dual broadband dipole array antenna as claimed in claim 1, wherein the non-connecting edges of the parallel panels are 20 mm;
the outer angle of the ground structure is 35°;
the inner angle of the ground structure is 70°;
the non-connecting edge of each congruent panel is 60 mm;
the connecting edge of each congruent panel is 20 mm;
a length difference between the connecting point to the ends of the conductive wire is 47.5 mm;
the feeding wire is 3 mm;
the vertex angle of the vertex is 135°; and
the base edge of the triangular segment is 60 mm.

* * * * *